PROCESS FOR THE MANUFACTURE OF DESULFURIZING AGENTS FOR CRUDE IRON OR STEEL MELTS

The present invention relates to a process for the manufacture of desulfurizing agents containing 1-6% by weight of chemically bonded water, based on calcium oxide-containing calcium carbide, for crude iron and steel melts.

The desulfurization of crude iron and steel melts by means of calcium carbide (referred to hereinafter as carbide) containing calcium oxide (briefly referred to hereinafter as lime) is generally known (DE-PS No. 1 160 457, DE-PS No. 20 37 758).

Heretofore, it has been customary to prepare these desulfurizing agents by processes, wherein the required amount of finely divided lime was introduced into molten carbide in order to produce a homogeneous mixture in the melt, which was then allowed to cool and was comminuted.

Preferably, the finely divided lime was introduced into the stream of carbide tapped off from the furnace. Although the amount of lime that can be introduced into the carbide melt is limited and there are risks associated with working with liquid carbide, it has long been held in the art that this method could not be avoided since it was thought that only a mixture of $CaC_2$ and CaO produced in the melt was ideally suited for desulfurization of metal melts.

Desulfurizing agents based on calcium carbide that contain substances which split off water at the temperature of the metal melt have already been described in DE-AS No. 22 52 795. These agents, which are mixtures of customary commercial carbide with, for example, $Ca(OH)_2$ as the substance that splits off water, have the disadvantage that they are mixtures produced by mechanical mixing processes in which carbide particles exist separately from the $Ca(OH)_2$ particles, so that the use of these products leads to higher consumption, irregular and vigorous gas reactions and a large variation as regards the desulfurizing efficiency, rendering difficult any controlled use of these agents.

The present invention now unexpectedly provides a process for making a highly effective desulfurizing agent for crude iron and steel melts which process permits the disadvantages of prior art methods to be avoided and which comprises: thermally producing from lime and coke a molten starting mixture of carbide and calcium oxide with a CaO content varying within the range 20 to 80%; allowing the mixture to cool and solidify into a block; rough-crushing the solidified block while it still has an average temperature of more than 400° C., preferably of between 400° C. and the solidification temperature of the melt, to particles with a size of less than 150 mm and calcium oxide; and admixing the comminuted mixture, which still has a temperature of at least 400° C., with a quantity of calcium oxide, necessary to establish in the mixture a total content of CaO corresponding to the CaO content desired in the end product. Preferably, calcium oxide is added in a quantity necessary to establish in the mixture a total content of CaO of more than 45% up to 90% by weight. Next, the mixture is ground with intensive mixing and in the presence of air or nitrogen having a moisture content of 5 to 20 g/m$^3$ (at 1.013 bar and 273.15 K) at temperatures below 100° C., preferably at 10°-50° C., to particles with a size of less than 10 mm, preferably of less than 100 μm.

A preferred feature of the present process provides for the molten starting mixture of calcium carbide and calcium oxide to contain 20 to 45% by weight of CaO, the mixture having been obtained from lime and coke in known manner by thermal treatment. It is also possible, however, initially to produce a molten starting mixture of calcium carbide and calcium oxide with a CaO content of more than 45% up to 80% by weight, by introducing finely divided calcium oxide into an existing calcium carbide melt containing up to 45% by weight of CaO until establishment of a maximum CaO content of up to 80% by weight, then allowing the whole to solidify into a block, and rough-crushing the latter at temperatures of above 400° C.

The present process permits avoiding the mixing of the lime with a carbide melt and the difficulties associated therewith. In addition to this, the present process has, inter alia, the following beneficial effects: It is not necessary for the composition of the burden to be set in each particular case for producing the carbide melt, nor is it necessary for the lime to be first ground to a certain particle size. Use can rather be made of a carbide block with a $CaC_2$:CaO weight ratio which may vary within wide limits. In other words, the carbide block may contain $CaC_2$ and CaO in practically any ratio, and the lime can even be used in the form of coarse particles with a size within the range 8 to 60 mm, for example.

A further beneficial effect of the agent produced in accordance with this invention resides in the fact that on the surface each individual particle of $Ca(OH)_2$ lies close to $CaC_2$, with the result that the desulfurizing reaction is started very early and regularly. As a result of this, smaller amounts of desulfurizing agents are required to be used for producing comparable desulfurization results, which incidentally are controllable.

The following Examples illustrate the invention:

EXAMPLE 1

The starting material was a melt as customarily used for the manufacture of commercial carbide, the melt containing 80% by weight of $CaC_2$ and 20% by weight of CaO. A carbide block of corresponding composition was produced in known manner in a crucible by allowing this melt to cool.

After the block had cooled to an average temperature of approximately 600° C., it was rough-crushed to particles with a size of less than 150 mm and the carbide, still with a temperature of 500° C., was covered with a layer of sufficient lime with a particle size of 8 to 60 mm that the resulting mixture had a total CaO content of 50% by weight.

Next, the mixture was ground in a rotary mill, while 1500 m$^3$/h of air with a moisture content of 10 g/m$^3$ (at 15° C.) was passed therethrough. The throughput was 500 kg/h at 50° C., and the mixture was ground to particles with a size of up to 100 μm.

1500 kg of this product was used for customary desulfurization of 300 000 kg of a crude iron melt that contained 0.03% by weight of sulfur. The iron so treated contained 0.005% by weight.

EXAMPLE 2

Calcium carbide was thermally produced in known manner from lime and coke, the lime/coke mixture in the total burden being set at a weight ratio of approxi-

United States Patent [19]

Braun et al.

[11] 4,368,071

[45] Jan. 11, 1983

[54] PROCESS FOR THE MANUFACTURE OF DESULFURIZING AGENTS FOR CRUDE IRON OR STEEL MELTS

[75] Inventors: Albert Braun, Hürth-Burbach; Willi Portz, Erftstadt-Kierdorf; Georg Strauss, Erftstadt-Lechenich; Hans-Martin Delhey, Duisburg, all of Fed. Rep. of Germany

[73] Assignee: Hoechst Aktiengesellschaft, Fed. Rep. of Germany

[21] Appl. No.: 222,086

[22] Filed: Jan. 2, 1981

[30] Foreign Application Priority Data

Dec. 29, 1979 [DE] Fed. Rep. of Germany ..... 2952686

[51] Int. Cl.[3] ..... C21C 7/02

[52] U.S. Cl. ..... 75/0.5 R; 75/53; 75/58

[58] Field of Search ..... 75/0.5 R, 53, 58

[56] References Cited

U.S. PATENT DOCUMENTS 3,598,573 8/1971 Freissmuth ..... 75/58

4,260,413 4/1981 Freissmuth ..... 75/58

*Primary Examiner*—P. D. Rosenberg

*Attorney, Agent, or Firm*—Connolly and Hutz

[57] ABSTRACT

The present invention relates to a process for the manufacture of desulfurizing agents containing 1–6% by weight of chemically bonded water, based on calcium oxide-containing calcium carbide, for crude iron and steel melts. To this end, a molten mixture of calcium carbide and calcium oxide with a CaO content of 20 to 80% by weight is produced, which is allowed to solidify into a block. Next, the block which still has an average temperature of more than 400° C., is rough-crushed to particles with a size of less than 150 mm and calcium oxide is added to the comminuted mixture, which still has a temperature of at least 400° C., in accordance with the CaO content desired in the end product. The mixture is finally ground in the presence of air or nitrogen with a moisture content of from 5 to 20 g/m$^3$ (at 1.013 bar and 273.15 K) at temperatures below 100° C. to particles with a size of less than 10 mm.

7 Claims, No Drawings